US005526981A

United States Patent [19]

Sanson

[11] Patent Number: 5,526,981

[45] Date of Patent: Jun. 18, 1996

[54] ADHESIVE SPRAY SYSTEM, AND METHODS OF CONSTRUCTING AND UTILIZING SAME

[76] Inventor: Bruce A. Sanson, 6650 Heatherwood Dr., West Bloomfield, Mich. 48324

[21] Appl. No.: 332,396

[22] Filed: Oct. 31, 1994

[51] Int. Cl.[6] ..... B05B 7/18

[52] U.S. Cl. ..... 239/8; 239/13; 239/135; 239/290; 239/527

[58] Field of Search ..... 239/132.1, 135, 239/137, 138, 139, 296, 290, 530, 8, 13, 526–528, 413–415

[56] References Cited

U.S. PATENT DOCUMENTS

| | | | |
|---|---|---|---|
| Re. 33,481 | 12/1990 | Ziecker et al. . | |
| 1,642,418 | 9/1927 | Kovanda | 239/132.1 |
| 1,968,992 | 8/1934 | Lonkling | 239/132.1 X |
| 2,976,392 | 3/1961 | Wabnitz | 239/290 X |
| 3,589,612 | 6/1971 | Shaffer | 239/139 |
| 4,669,661 | 6/1987 | Otto | 239/528 X |
| 5,065,943 | 11/1991 | Boger et al. . | |
| 5,292,068 | 3/1994 | Raterman et al. | 239/135 X |

FOREIGN PATENT DOCUMENTS

| | | | |
|---|---|---|---|
| 3501446 | 7/1986 | Germany | 239/155 |
| 3540619 | 5/1987 | Germany | 239/135 |

*Primary Examiner*—Kevin P. Weldon

*Attorney, Agent, or Firm*—Weiner, Carrier & Burt; William F. Esser; Irving M. Weiner

[57] ABSTRACT

A system for spraying water-based adhesive and a method of using the system is disclosed. The system includes a hot air gun connected to both a source of hot pressurized air and a source of flowable adhesive. The gun includes a body having a handle assembly and a spraying assembly. The handle assembly includes a depressible trigger and first knob for adjusting the amount of flowable adhesive in the spray gun and a second knob for adjusting the pattern of the spray. The spraying assembly includes a spray nozzle and control valves operably connected with the trigger for controlling the flow of pressurized hot air and adhesive. The spraying assembly also includes an air routing insert for routing air currents to the nozzle and an adhesive fluid tube for routing adhesive fluid to the nozzle. The adhesive fluid is atomized upon leaving the nozzle when combined with the hot pressurized air.

20 Claims, 5 Drawing Sheets

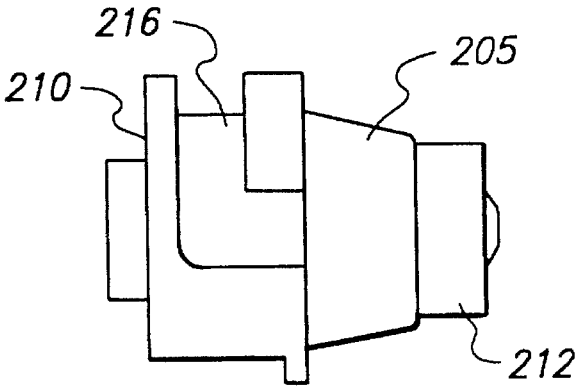
FIG. 4
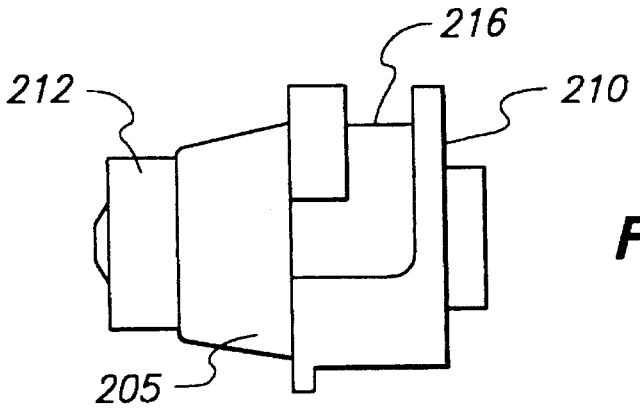
FIG. 5
FIG. 6
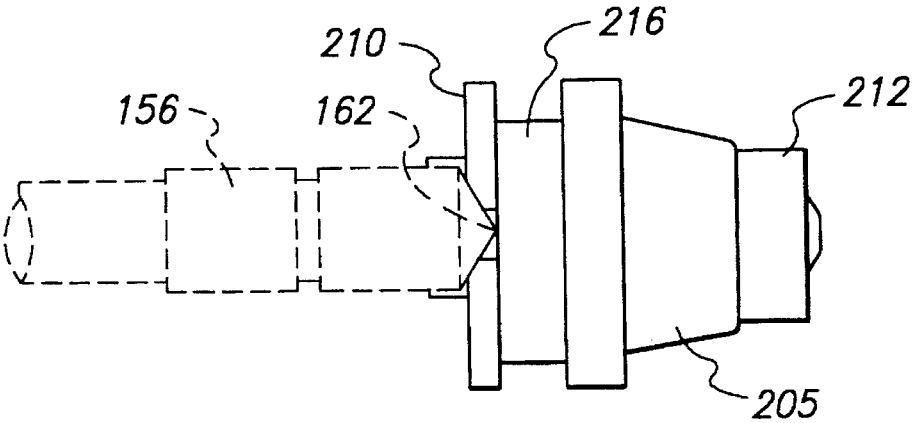

ADHESIVE SPRAY SYSTEM, AND METHODS OF CONSTRUCTING AND UTILIZING SAME

BACKGROUND OF THE INVENTION

1. Technical Field

The invention is directed to the application of adhesives. Particularly, the invention is directed to a system and process for spraying water-based adhesives, and an air gun for drying sprayed water-based adhesives.

2. Discussion

Adhesives are well-known for providing or promoting adhesion between two articles. Earliest adhesives were based on naturally-occurring substances with little or no processing from their natural forms. Many adhesives are still based on naturally-occurring substances, but have been subjected to processing.

The most notable development in adhesives in recent times has been the use of organic compound-based adhesives. These modern adhesives are based on the synthetic derivation of organic polymers. Solvent-based adhesives are used in the construction and manufacturing industries.

Typical of these types of adhesives is the "hot-melt" thermoplastic adhesive. Present-day versions of the hot-melt adhesive are composed of polymers such as ethylene-vinyl acetate copolymers, polyamides, polyesters, and polyethylene.

Hot-melt adhesives may be applied in a thick consistency or may be applied as a spray. Devices for spraying heated hot-melt adhesive materials are known. A typical example of such a device is disclosed in Ziecker et al U.S. Pat. No. Re. 33,481 which is directed to a spray system for spraying heated hot-melt adhesive in elongated strands or fibers in controlled spiral patterns.

Boger et al. U.S. Pat. No. 5,065,943 discloses a cap adapted for use with an adhesive dispensing device. Like the device of Ziecker et al., the Boger et al. device lays down an elongated adhesive fiber onto a substrate in a controlled spiral pattern.

While these devices have utility in providing a method for dispensing solvent-based adhesives, these adhesives themselves are regarded as being undesirable for widespread use. A popular solvent used in these adhesives has historically been trichlorofluoromethane (fluorotrichloromethane) derived from carbon tetrachloride and hydrogen fluoride. While providing good adhesion, trichlorofluoromethane is believed to be responsible in part for depletion of the ozone layer. As a result, methylene chloride (dichloromethane) has been more recently substituted for trichlorofluoromethane to overcome the ozone-depletion problem. However, methylene chloride is itself now believed to pose a danger as a carcinogen. It is now apparent that while solvent-based adhesives provide very good adhesion characteristics, their usefulness is severely compromised by their known and suspected dangers to people and the environment.

As a substitute for these adhesives, water-based adhesives have been more recently used. While overcoming the chemical dangers of solvent-based adhesives, the principal difficulty of these adhesives is that they dry very slowly when compared to their solvent-based counterparts, particularly when these adhesives are sprayed onto a substrate. Known systems for applying water-based adhesives that demonstrate an acceptable drying time are wanting.

SUMMARY OF THE INVENTION

An object of the invention to overcome the disadvantages of known solvent-based adhesives by providing an adhesive spraying system that utilizes water-based adhesives.

Another object is to provide such a system which atomizes the liquid adhesive prior to its deposition on a substrate.

Another object is to provide such a system that utilizes hot compressed air as a vehicle for atomizing and carrying the liquid adhesive to the target substrate.

Another object is to provide a system for spraying adhesives that allows for adjustment of the spray pattern.

Another object is to provide such a system that is easy to operate and simple to maintain.

Another object is to overcome the disadvantages of known adhesive spray system by providing an air gun that allows the operator to apply a stream of drying air to the adhesive surface after it is sprayed to accelerate drying time.

Another object is to provide such an air gun which atomizes the liquid adhesive prior to its deposition on a substrate.

The invention achieves these objectives by providing a system and process for spraying a liquid adhesive that comprises a hot air gun connected to a source of hot pressurized air and a source of flowable adhesive.

The gun includes a body having a handle assembly and a spraying assembly. The handle assembly includes a depressible trigger, a knob for adjusting the amount of the liquid adhesive relative to hot pressurized air in the air-adhesive spray, and a knob for adjusting the pattern of the spray.

An air diverter is attached to the body of the gun for diverting an amount of hot compressed air from the air-adhesive spray directly onto the sprayed substrate to accelerate drying of the adhesive. The air diverter includes a diverter body, a diverter plenum connected to the underside of the body, an air diverter piston axially movable within the air divert body top, and a piston shroud through which diverted air exits.

The spraying assembly of the gun includes a central spray nozzle provided within a head module and shut-off valves operably connected with the trigger for selectively controlling the flow of incoming pressurized hot air and liquid adhesive. The spraying assembly also includes an air routing insert for routing air currents around and in front of the nozzle and an adhesive fluid tube for routing another current of compressed air and adhesive fluid through the nozzle. The liquid adhesive and the hot compressed air within the tube combine at the nozzle tip and the liquid is atomized. Additional opposed air channels are provided on the nozzle tip to allow passage of the air current directed around the front of the nozzle to fan the air-adhesive mixture so as to lay down a desired pattern of adhesive spray.

The hot pressurized air source includes a compressor for compressing ambient air, a heat exchanger for heating the compressed air, and regulators for regulating the pressure of the hot compressed air entering the gun.

The flowable adhesive source includes a tank for holding liquid adhesive, a compressor for pressurizing the liquid adhesive in the tank, and a regulator for regulating the amount of the adhesive entering the gun from the tank.

The invention will be more fully understood by reference to the following detailed description of the preferred embodiments of the invention when read in conjunction with the accompanying drawings, in which like reference characters refer to like parts throughout the views.

BRIEF DESCRIPTION OF THE DRAWINGS

FIG. 4 is a view of one side of the air insert.

FIG. 5 is a view illustrating the side of the insert opposed to the side shown in FIG. 4.

FIG. 6 is a top view of the insert shown in FIGS. 4 and 5.

DETAILED DESCRIPTION OF THE PREFERRED EMBODIMENT

Figure 1:
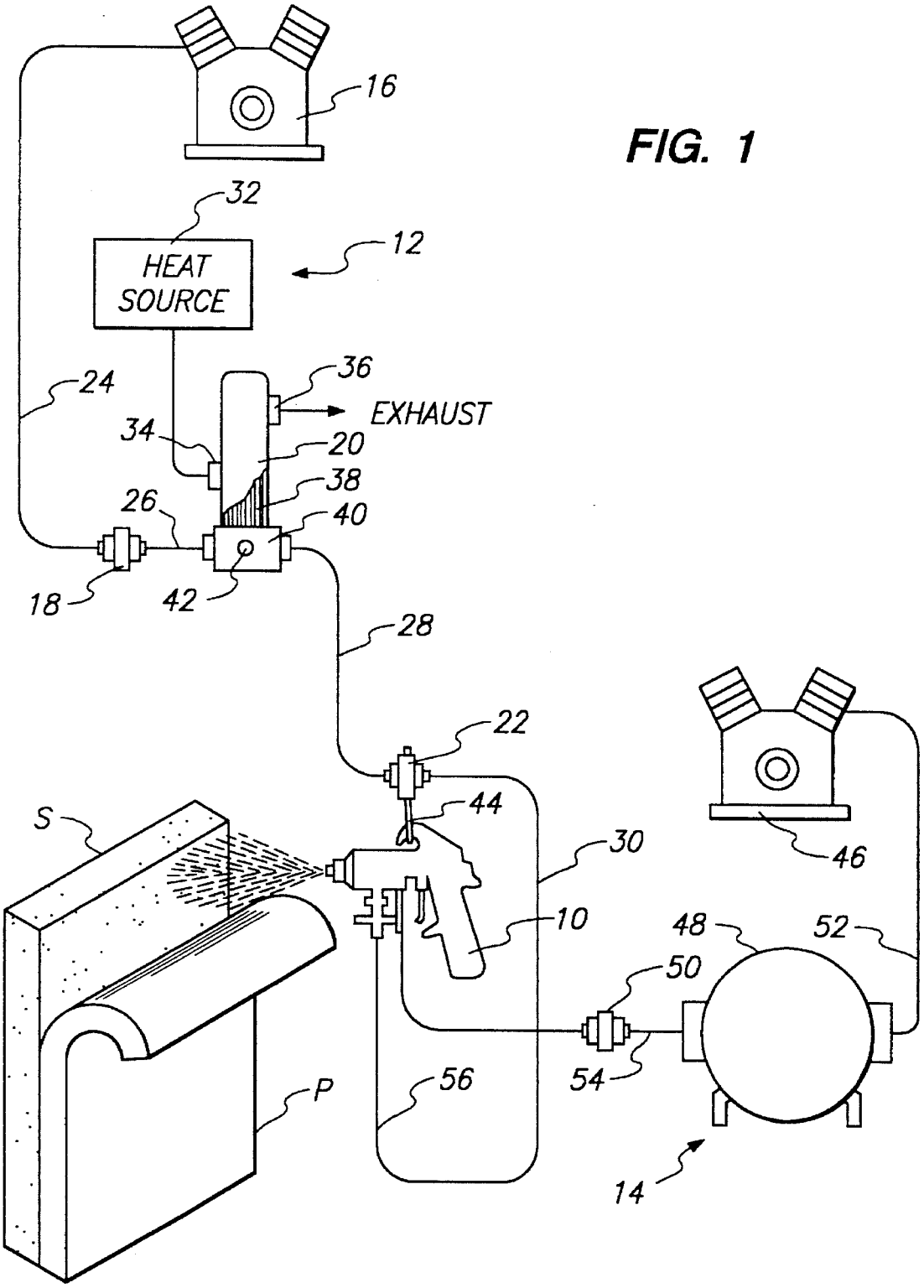
FIG. 1 is an environmental view illustrating an adhesive spraying system incorporating the hot air gun of the invention for application of adhesives to an article to be fastened to another article.

The drawing discloses the preferred embodiment of the invention. While the configurations according to the illustrated embodiment are preferred, alternate configurations may be adopted without deviating from the invention.

FIG. 1 shows an environmental view of an adhesive application system incorporating an adhesive spray gun 10. Gun 10 combines liquid adhesive with hot compressed air to produce a hot spray consisting of a hot air-adhesive mixture containing atomized adhesive fluid. An air heating and pressurizing assembly 12 and a liquid adhesive delivery system 14 provide the air and adhesive to gun 10, which then applies it as an air-adhesive spray to a substrate 5 so that a piece P may be attached thereto. Substrate S and piece P are illustrative, and the system may be used for adhering together any articles that may be bonded by an adhesive.

Assembly 12 includes an air compressor 16 for compressing ambient air, a first air regulator 18 for regulating the air, a heat exchanger 20 for heating the compressed air, and a second air regulator 22 for regulating the heated compressed air prior to being introduced into gun 10. An air line 24 fluidly connects compressor 16 with regulator 18, an air line 26 connects regulator 18 with exchanger 20, an insulated air line 28 connects exchanger 20 with regulator 22, and a third insulated line 30 connects regulator 22 with gun 10.

Exchanger 20 includes a heat source 32 powered by electricity or a flammable fuel that provides hot air to an annular distributor 34. An exhaust port 36 allows the hot, circulating air to exit the exchanger 20. Distributor 34 encases a series of sealed tubes 38 fluidly connected with a pressurized air channel 40 through which flows pressurized air regulated by regulator 18. The pressurized air enters channel 40, is circulated through tubes 38 which are surrounded by hot air, returns to channel 40, and leaves exchanger 20 to regulator 22. Exchanger 20 includes a temperature control knob 42 for selectively controlling the temperature of the exhausted compressed air.

Regulator 22 is fitted with a gun hanger switch 44 which controls the air pressure. When gun 10 is not in use, it is hung from switch 44 which reduces the pressure of the hot compressed air being delivered to exchanger 20 from an operating pressure of between 10–16 p.s.i. to an idling pressure of between 1–2 p.s.i. Exchanger 20 will not operate unless it receives at least 0.5 p.s.i. of compressed air at channel 40.

System 14 includes a compressor 46 for compressing ambient air, an adhesive tank 48, and a fluid regulator 50. An air line 52 connects compressor 46 to tank 48, a first adhesive line 54 connects tank 48 to regulator 50, and a second adhesive line 56 connects regulator 50 with gun 10. The adhesive contained in tank 48 and forced into gun 10 is liquid at room temperature.

Figure 2:
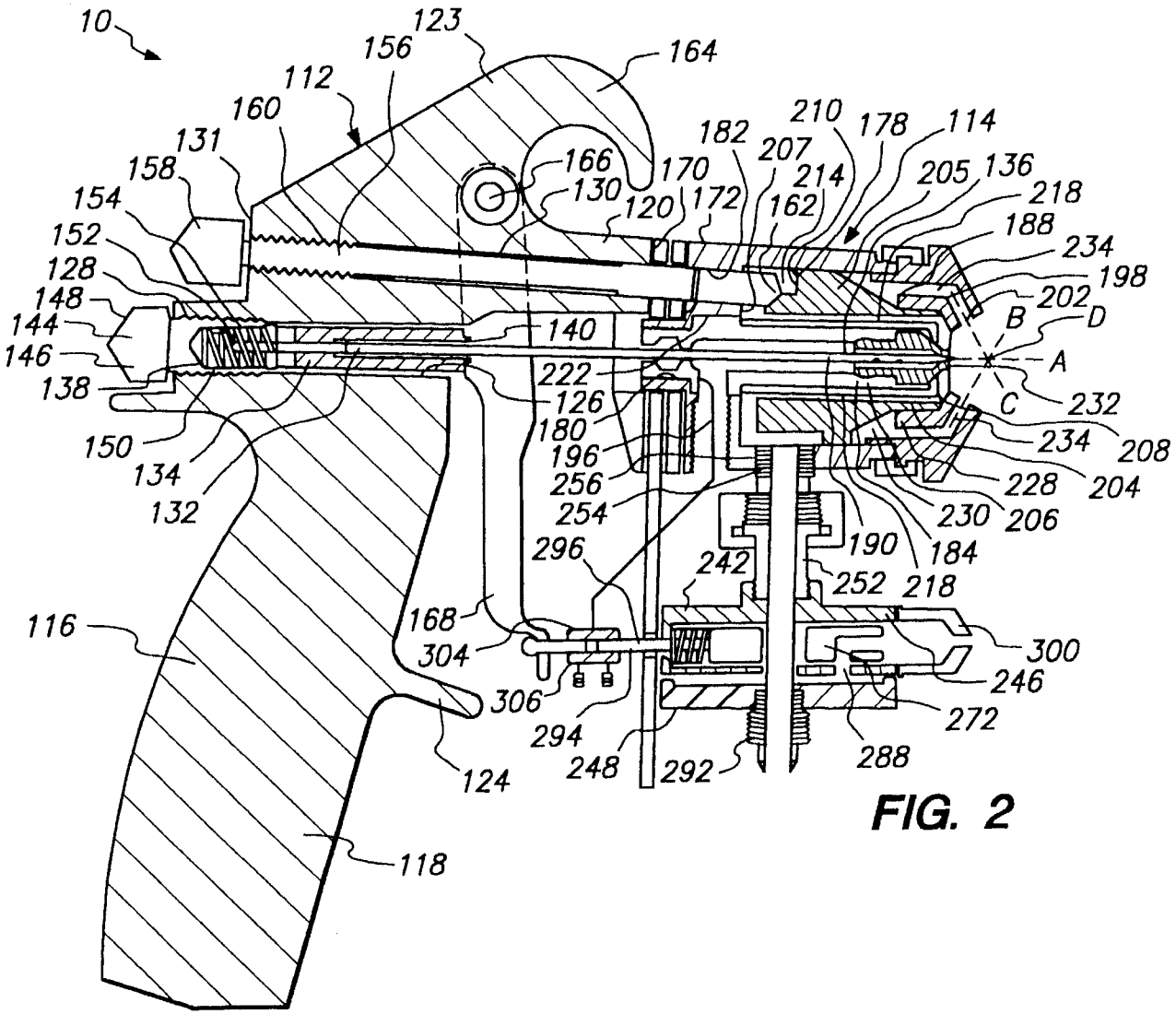
FIG. 2 is an elevational sectional view of the hot air gun.
Figure 3:
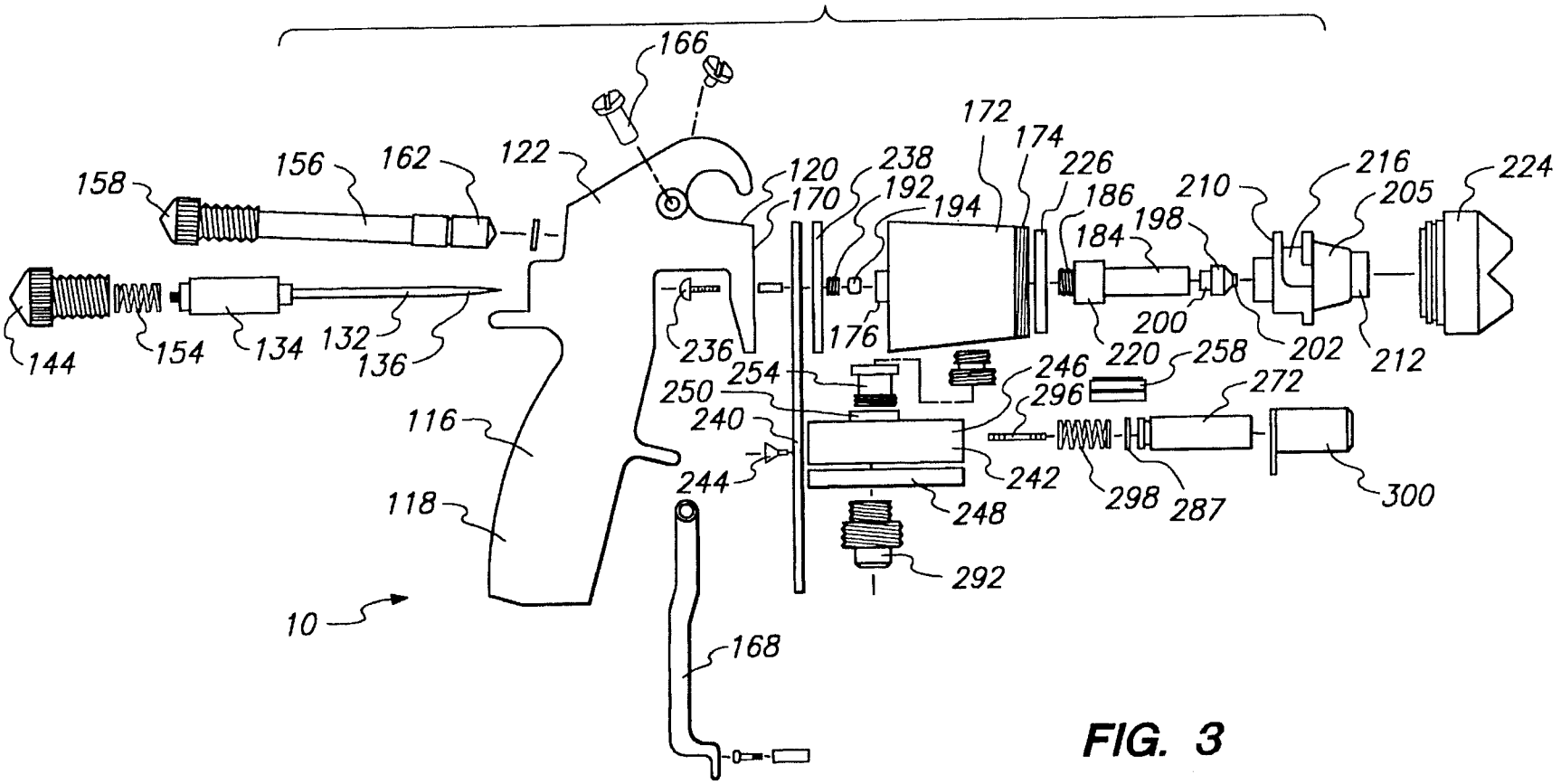
FIG. 3 is an exploded view of the hot air gun of FIG. 2.
Figure 7:
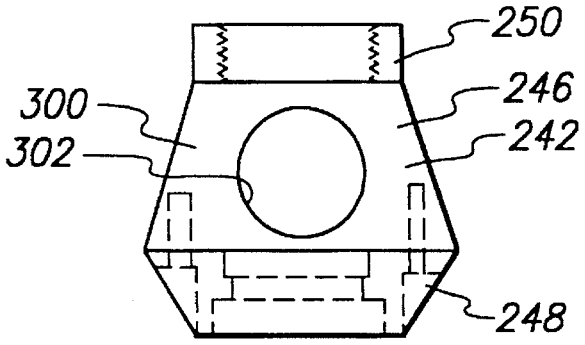
FIG. 7 is a front view of the air diverter.
Figure 8:
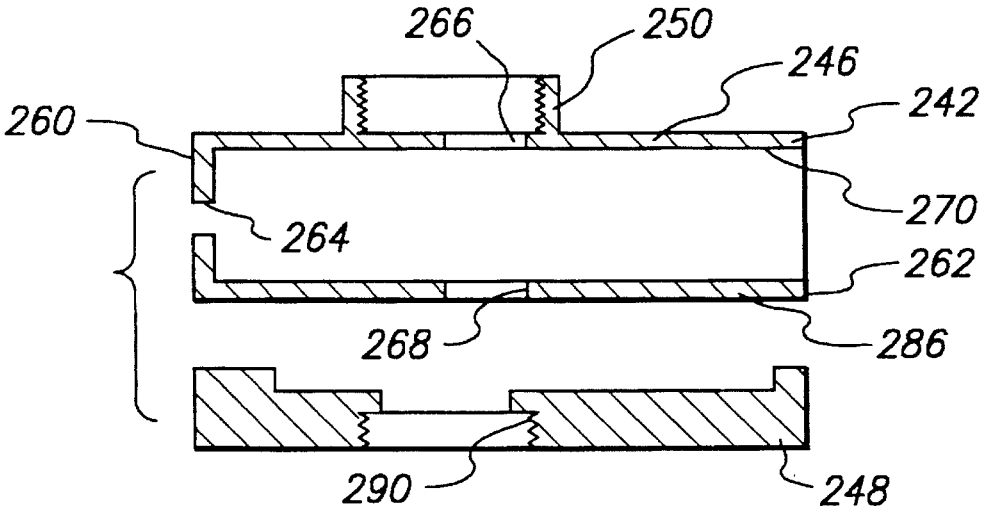
FIG. 8 is a sectional view taken along the long axis of the air diverter.
Figure 9:
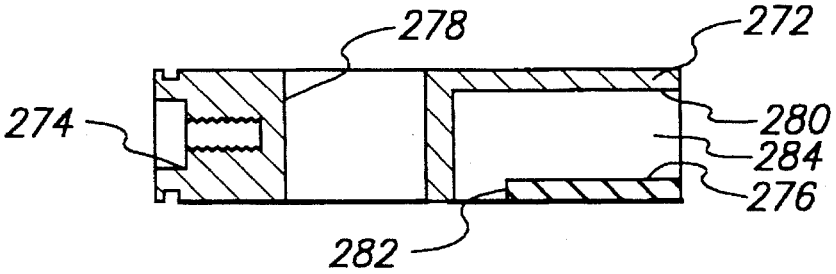
FIG. 9 is a sectional view taken along the long axis of the air diverter piston.

FIGS. 2 and 3 show gun 10 which includes a handle assembly 112 and a spray assembly 114.

Assembly 112 includes a grip-type gun body 116 composed of a durable, lightweight material such as a plastic or a lightweight metal. Body 116 includes a grip portion 118, a spray assembly supporting portion 120, and an intermediate adjustment—supporting portion 122. Portion 118 is configured to fit comfortably in the user's palm. To enhance the fit and to enable the user to better grip gun 10, a finger support 124 is integrally mated with portion 118.

Portion 122 includes a first throughbore 126 having a threaded end 128 and a second throughbore 130 also having a threaded portion 131. Throughbore 130 terminates at portion 118.

Within throughbore 126 is provided an axially-adjustable fluid adjusting needle 132 having a needle adjusting sleeve 134 and a pointed end 136. Sleeve 134 includes a spring biasing end 138 and a trigger abutment end 140.

A fluid volume control knob 144 includes a knob body 146 having a knurled end 148 and an opposite threaded end 150. End 150 is threadably adapted for mating with end 128. A counterbore 152 is defined within end 150 and extends into body 146. Nested substantially within counterbore 152 is a fluid volume control return spring 154 that is biased between the end wall of counterbore 152 and end 138. Spring 154 maintains assembly 132 in spaced-apart relation from knob 144.

Within throughbore 130 is provided an axially-adjusted fan air control rod 156 having a knurled end 158, a threaded portion 160 adjacent the end 158, and a conically-shaped shut-off end 162. Portion 160 is threadably adapted for mating with portion 131. End 162 extends beyond the end of portion 120 and into assembly 114.

A hanger 164 extends from portion 122 and enables gun 10 to be hung, when not in use, on the switch 44. While hanger 164 is represented as having a "C"-shaped configuration, alternate configuration could be used.

Pivotally attached to portion 122 by a trigger axle 166 is a trigger 168 which is manipulated by the hand of an operator to control the air-adhesive mixture escaping from gun 10. The back side of trigger 168 abuts end 140 of sleeve 134. When the operator squeezes trigger 168 toward the grip portion 118, the spring 154 is compressed between the spring biasing end 138 of the sleeve 134 and the interior wall of the counterbore 152 of the knob 146. Spring 154 resists this movement and urges trigger 168 forward to its resting position.

Spray assembly portion 120 includes a spray assembly abutment face 170 to which is fitted the spray assembly 114. Assembly portion 120 includes a spray assembly abutment face 170 to which is fitted the spray assembly 114. Assembly 114 comprises several screw-or bolt-together components preferably composed of one of several rigid plastics or of a lightweight metal such as aluminum, assembly 114 includes air and adhesive routing channels, and a spray head module 172 includes an externally threaded end 174 and a sleeve end 176. Internally module 172 defines a central counterbore 178 that opens toward end 174 and is continuous with end 176 via a threaded throughbore 180. An additional smooth throughbore 182 is continuous between the exterior of module 172 and counterbore 178 to accommodate the shut-off end 162 of the rod 156.

Within counterbore 178 is fitted a fluid tube 184 having an externally threaded end 186 and an internally threaded end 188. An axially-defined central throughbore 190 is defined within tube 184 and is continuous between the ends 186 and 188.

End 186 is threadably mated with throughbore 180. A packing nut 192 is also threadably mated with throughbore 180. Between the inner side of nut 192 and the end of the tube 184 is provided a packing 194 composed of a liquid-resistant material. Packing 194 is forced between nut 192 and tube 184 to create a fluid-tight seal preventing fluid from escaping from module 172 along needle 132. Throughbore 190 intersects a radially-aligned fluid inlet bore 196.

At the end of tube 184 is a fluid nozzle 198 having an external thread 200 and a fluid tip 202. Thread 200 is threadably mated with end 188. An axially-defined central throughbore 204 is defined within nozzle 198. Throughbore 204 includes a wide region 206 that communicates with throughbore 190 and a restricted region 208 that provides a seat for pointed end 136 of needle 132 within tip 202.

Clockwise rotation of knob 146 further biases spring 154 against the adjusting sleeve end 134 urging the assembly so that the pointed end 136 extend further toward the needle seat defined within nozzle 198. Counterclockwise rotation of knob 146 causes end 136 to move away from the seat.

Also fitted within counterbore 178 is an air routing insert 205 (FIGS. 4–6). Insert 205 includes a cavity -defining end 210 and a nozzle end 212. As illustrated in FIG. 2, end 210 is disposed within module 172 in a spaced-apart relationship from an inner wall 207 of counterbore 178, thus defining a cavity 214. Cavity 214 is an air passage that fluidly communicates with the air heating and pressurizing assembly 12. An air-routing channel 216 is defined on the outside of insert 205. Channel 216 wraps partially around insert 205, travelling from right to left on insert 205 as illustrated in FIG. 3 and left to right as illustrated in FIG. 4, the latter view being opposite that of the former. On both sides channel 216 is initially defined along the long axis of the insert, then curves toward the top dead center of insert 205 (FIG. 6), and continues on to the opposite side (FIG. 5) defining a continuous channel. A seat 217 (FIG. 6) is defined at that point of channel 216 that is top dead center of insert 205 for seating shut-off end 162 of rod 156. End 162 is shown in shadow lines in FIG. 6 in its fully seated position, closing off air flow between cavity 214 and channel 216. Channel 216 directs a controlled amount of air in two separate streams toward the sides of the tip of nozzle 198.

Rotation of knurled end 158 in a clockwise direction adjusts rod 156 forwardly into seat 217 of air-routing channel 216 reducing the amount of hot pressurized air entering the channel. Counterclockwise rotation of end 158 achieves the opposite result.

A series of air passageways 218 are defined in an array around the central throughbore 190 of insert 205. Passageways 218 allow passage of hot pressurized air between cavity 214 and to the nozzle end 212.

Tube 184 includes an annular flange 220 adjacent end 186 that fits snugly into a bore 222 defined between and concentric with bore 222 and throughbore 180. Seated in this manner, part of tube 184 is suspended within throughbore 190 defined axially within insert 205 (FIG. 2).

Attached to end 174 is an air cap 224 with an insulating cap washer 226 fitted therebetween. Cap 224 includes an inner wall 228 that is positioned in spaced-apart relation from the nozzle-supporting end of the tube 184, defining a cavity 230. A circular aperture 232 is defined in wall 228 through which tip 202 of nozzle 198 is disposed. Aperture 232 is larger than the circumference of tip 202, and an air passage in the shape of a ring is defined between the two. In operation, hot pressurized air from cavity 214 passes through passageways 218, into cavity 230, and along tip 202 through aperture 232, where it forms a spray stream with the adhesive fluid, the stream being indicated as A in FIG. 2, exiting from the middle of tip 202. The adhesive fluid is atomized by this current of air.

Cap 224 includes a pair of opposed air channels 234 and 234' which are in fluid communication with cavity 214, providing two opposed fanning air currents B and C that exhaust cap 224 concurrent with the air-adhesive mix A. Currents B and C exiting cap 224 are directed angularly toward one another such that they intersect each other and the stream A in front of tip 202 approximately at point D. Intersecting currents B and C fan the current A to form a controlled (via operator adjustment of rod 156) lay-down pattern of the adhesive.

Assembly 114 is connected to portion 118 by a pair of fasteners of which one, 236, may be seen. Fastener 236 and its unseen twin are provided to both sides of needle 132. Two plates—a body washer 238 and an air control body support shield 240—are fitted between assembly 114 and portion 118.

The air control body support shield 240 provides support for an air control body 242. Body 242 includes a closed end 244 and an open end 246 having an external thread 248. On the upper side of body 242 is provided a pressurized fluid exhaust port 250. Port 250 is fluidly connected with cavity 214 defined between wall 207 of module 172 and insert 205 by an air insulating outlet fitting 252 and an air inlet fitting 254. The top end of fitting 254 is threaded into an aperture 256 defined in the underside of module 172. The top end of fitting 252 is mated with fitting 254 by a ring nut 258. The bottom end of fitting 252 is threaded into port 250. Compressed air exiting body 242 is in fluid communication with cavity 214 through fittings 252 and 254.

An air inlet hose fitting 260 is threadably attached to the underside of body 242. Hot pressurized air enters the lower end of fitting 260 and is directed to a counterbore 262 defined within body 242. The position of a control piston 264 determines whether or not compressed air is allowed to enter gun 10 from fitting 260. Piston 264 has a control attachment end 266. Piston 264 has defined therethrough a transverse bore 268 that, when aligned between the passageway defined through fittings 260 and 252, permits the passage of pressurized air into gun 10 to cavity 214. A fluid sealing O-ring 267 is fitted on piston 264.

A piston control assembly 270 controls axial movement of piston 264. Assembly 270 includes a connecting rod 272 that connects the lowest end of trigger 168 with end 266. Rod 272 is axially movable through an aperture 274 defined in the end wall 244 of body 242. A piston return spring 276 is provided between the inner side of wall 244 and piston 264. Spring 276 urges piston 264 toward its closed position as illustrated in FIG. 2. An air control body cover 278 includes an internal thread that threadably mates with thread 248. A sealing ting 280 is fitted between the end of body 242 and cover 278, providing a fluid-tight environment within body 242.

Also attached to rod 272 is an adhesive flow valve 282. Valve 282 is fitted between the liquid adhesive delivery system 14 and an adhesive inlet port 284 defined in the lower side module 172. Port 284 is in fluid communication with the fluid inlet bore 196 for passage of adhesive therethrough.

Operation of gun 10 is as follows. When trigger 168 is in its closed or resting position, as illustrated, flow of adhesive into port 284 is halted by valve 282 as is flow of the pressurized and heated air into cavity 214 by the closed, non-aligned position of piston 264. The needle end of needle 132 is also seated in tip 202 of nozzle 198.

When the operator squeezes trigger 168 toward portion 118, three events simultaneously occur. First, piston 264 is moved forwardly in response to forward movement of rod 272, and heated and pressurized air enters cavity 214, passing both around tip 202 and through channel 216. Second, valve 282 is placed into its open position, and adhesive fluid under pressure is allowed to enter throughbore 190. Third, the adhesive fluid in throughbore 190 is allowed to pass through tip 202 in response to the point of needle 132 being drawn away from its seat within nozzle 198 on the action of sleeve 134 being rearwardly acted upon by trigger 168.

Adjustment of both flow of the adhesive out of tip 202 and flow of the air comprising the air fan may be readily made. Adhesive flow is adjusted by rotation of knob 146 clockwise or counterclockwise. The amount of fan air passing through channel 216 is controlled by rotation of end 158.

With gun 10 hung on switch 44 and with tank 48 being filled with a water-based adhesive fluid, compressors 16 and 46 as well as heat exchanger 20 are activated. The operator must thereafter wait about two minutes to allow exchanger 20 to warm to its operating temperature. Knob 42 of exchanger 20 is adjusted to between 125° and 600° F. Gun 10 is removed from switch 44 and the pressure delivered to gun 10 increases to its operating pressure of between 10 and 16 p.s.i. Pressures may be adjusted and varied more or less depending upon rheology of the particular adhesive used. The operator adjusts end 158 to control the pattern of the spray and adjusts knob 146 to control the amount of adhesive in the spray. The adhesive is released from gun 10 when the operator depresses trigger 168.

Adhesive drying time depends on the ambient air conditions (temperature and humidity), film thickness, and the temperature of the heated compressed air. After the preferred amount of adhesive is sprayed, gun 10 is returned to switch 44, returning pressure output to between 1–2 p.s.i., thus saving energy while keeping the system on a stand-by status for the next spraying operation. Once operations are complete, any remaining adhesive is flushed out of gun 10 with clean water.

The broad teachings of the present invention can be implemented in a variety of forms. While the invention has been described in connection with particular examples thereof, the true scope of the invention should not be so limited since other modifications will become apparent to the skilled practitioner upon a study of the drawings, specification and following claims.

I claim:

1. A system for spraying water-based adhesives, comprising:

an adhesive gun having a liquid adhesive channel for carrying liquid adhesive and a hot pressurized air channel for carrying hot pressurized air, said gun including an air routing insert having a long axis and an axially-defined throughbore, said gun including a nozzle disposed substantially within said throughbore of said insert, said nozzle having a long axis and an axially-defined throughbore, said adhesive channel being continuous with said throughbore of said nozzle, said insert including a plurality of air passageways axially defined in an array around said throughbore of said insert, said air passageways being continuous with said air channel, said throughbore of said nozzle and said passageways opening in proximity with one another such that said adhesive discharging said throughbore of said nozzle is atomized in an air-adhesive stream by said hot pressurized air discharging said passageways surrounding said throughbore of said insert;

said insert includes a first air fanning channel and a second air fanning channel, said channels being continuous with said hot pressurized air channel, said first channel discharging said hot pressurized air on a first side of said stream, said second channel discharging said hot pressurized air on a second side of said stream, and said first and second channels being opposed to each other;

a source of hot pressurized air;

an air line connecting said source with said air channel;

a source of liquid adhesive; and a liquid adhesive line connecting said source of adhesive with said adhesive channel.

2. The system of claim 1 wherein said gun includes an adhesive control valve operatively associated with said throughbore of said nozzle for adjusting the amount of adhesive entering said stream.

3. The system of claim 1 wherein said gun includes a control valve operatively disposed between said hot pressurized air channel and said fanning channels for controlling the volume of air entering said fanning channels.

4. The system of claim 1 wherein said source of hot pressurized air comprises a compressor and a unit for heating air, said air line comprising a first air line connecting said compressor and said heating unit and a second air line connecting said heating unit and said gun, and said source of hot pressurized air including insulation provided about said second air line.

5. The system of claim 4 wherein said heating unit comprises a heat exchanger including a temperature control.

6. The system of claim 4 wherein said first air line includes an air pressure regulator.

7. The system of claim 6 wherein said second air line includes an air pressure regulator and a switch for substantially automatically adjusting air pressure in said second air line to a standby pressure when said adhesive gun is engaged therewith.

8. The system of claim 1 wherein said source of liquid adhesive comprises a liquid adhesive storage tank, a compressor, a compressor line connecting said tank with said compressor, and an adhesive line connecting said tank and said liquid adhesive channel.

9. An adhesive gun, comprising:

a liquid adhesive channel for carrying liquid adhesive and a hot pressurized air channel for carrying hot pressurized air;

an air routing insert having a long axis and an axially-defined throughbore;

a nozzle disposed substantially within said throughbore of said insert;

said nozzle having a long axis and an axially-defined throughbore;

said adhesive channel being continuous with said throughbore of said nozzle;

said insert including a plurality of air passageways axially defined in an array around said throughbore of said insert;

said air passageways being continuous with said air channel; and said throughbore of said nozzle and said passageways opening in proximity with one another such that said adhesive discharging said throughbore of said nozzle is atomized in an air-adhesive stream by said hot pressurized air discharging said passageways surrounding said throughbore of said insert;

an outer surface of said air routing insert being shaped to form a channel therealong, said channel being in fluid communication with said air channel so as to pass said hot pressurized air therethrough;

means for directing said hot pressurized air passing through said channel into opposed, intersecting currents of said hot pressurized air; and wherein said opposed, intersecting currents intersect forwardly of said nozzle so as to fan said air-adhesive stream.

10. An adhesive gun as recited in claim 9, further including:

an adhesive control valve operatively associated with said throughbore of said nozzle for adjusting the amount of adhesive entering air-adhesive stream.

11. An adhesive gun as recited in claim 9, further including:

a control valve for controlling a volume of said hot pressurized air in said air-adhesive stream and said intersecting currents.

12. A system for spraying liquid adhesive, comprising:

a spray gun including a handle assembly and a spray nozzle assembly, said handle assembly including a trigger, said nozzle assembly being attached to said handle assembly and including:

a spray head module having an open end and a first bore and a second bore, said bores being coaxial, said first bore being wider than said second bore, and being adjacent said open end and a second end;

a fluid tube having a flange end, a nozzle end, a central throughbore, and a flange defined on said flange end, said flange being fitted within said second bore;

a spray nozzle having a central adhesive-passing throughbore, said nozzle being attached to said nozzle end of said fluid tube;

a spray needle having a first end operatively attached to said trigger and a second end movably disposed within said nozzle throughbore, said needle being movable by said trigger between an adhesive-blocking position and an adhesive- passing position;

an air routing insert having a first end and a second end with a throughbore defined herebetween, said tube being partially disposed within said insert throughbore, said insert being disposed within said first bore such that a first cavity is defined between said insert, said tube, and said first bore, said insert having an outer peripheral wall with an air channel defined thereon, said insert having a plurality of air passageways defined between said insert ends, said plurality of passageways being arrayed around said insert throughbore;

a cap attached to said open end, and having a pair of opposed air passageways defined therein, said cap being attached to said module such that a second cavity is defined between said cap and said nozzle, said cap having an aperture centrally defined therein for allowing passage of said adhesive and hot compressed air, said cap being attached to said module such that a third cavity is defined between said module, said insert and said cap;

said plurality of insert air passageways being continuous between said first and second cavities whereby said compressed air passes through said second cavity and surrounds said nozzle as it is discharged through said cap aperture, said compressed air being discharged through said aperture in close proximity to said liquid adhesive being discharged from said nozzle such that said adhesive is atomizer;

said system comprising a source of said hot compressed air fluidly connected with said gun;

an air valve fitted between said gun and said source, said valve being operatively attached to said trigger, and being operable between an air-passing position and an air-blocking position;

a source of liquid adhesive fluidly connected with said gun; and a fluid valve fitted between said gun and said adhesive source, and being operatively attached to said trigger, and being operable between a fluid-passing position and a fluid-blocking position.

13. A system as recited in claim 12, wherein:

said air channel defined on said outer peripheral wall of said insert provides fluid communication between said first cavity and said third cavity; and said cap includes means for fanning hot compressed air which is discharged through said cap via said third cavity.

14. A system as recited in claim 13, wherein:

said fanning means include tab members for directing hot compressed air in opposed, intersecting patterns, said intersecting patterns intersecting forwardly of said nozzle.

15. A process for spraying water-based adhesives, comprising the steps of:

pressurizing ambient air with a first compressor to create a volume of pressurized air;

introducing said pressurized air into a unit for heating air;

heating said pressurized air in said unit to a preselected temperature;

pressurizing liquid water-based adhesive with a second compressor;

delivering said hot pressurized air and said pressurized liquid water-based adhesive to a spray gun;

regulating the flow of said air and said adhesive through said spray gun;

atomizing said adhesive as it is sprayed out of said gun using said hot pressurized air to create an air-adhesive spray; regulating the flow of said air through said gun includes regulating said pressurized air to between 10 and 16 p.s.i. prior to introducing said pressurized air into said unit for heating air;

substantially automatically reducing the pressure of said hot pressurized air to a standby pressure of between 1 and 2 p.s.i. between spraying operations;

fanning said air-adhesive spray with a pair of opposing, intersecting air streams to establish a selected pattern on said substrate; and laying down said air-adhesive spray onto a substrate.

16. The process of claim 15 including the step of regulating the amount of air in said two opposing air streams.

17. The process of claim 15 wherein each of said pair of opposing air streams is composed of said hot pressurized air.

18. The process of claim 15 wherein said step of regulating said adhesive through said spray gun includes adjusting a control on said gun to regulate the mount of the liquid adhesive part of said air-adhesive spray.

19. The process of claim 15 wherein said preselected temperature is between 125 and 600 degrees Fahrenheit.

20. The process of claim 15 including the step of allowing said unit for heating air to arrive at its operating temperature prior to said step of atomizing said adhesive.

* * * * *

UNITED STATES PATENT AND TRADEMARK OFFICE

CERTIFICATE OF CORRECTION

PATENT NO. : 5,526,981

DATED : June 18, 1996

INVENTOR(S) : Bruce A. Sanson

It is certified that error appears in the above-indentified patent and that said Letters Patent is hereby corrected as shown below:

Column 6, line 59, change "ting" to --ring--.

Signed and Sealed this

Tenth Day of September, 1996

*Attest:*

*Attesting Officer*

BRUCE LEHMAN

*Commissioner of Patents and Trademarks*